US010718342B2

(12) United States Patent
Chang et al.

(10) Patent No.: US 10,718,342 B2
(45) Date of Patent: Jul. 21, 2020

(54) CENTRIFUGAL FAN COMPRISING A SIDEWALL AND PLURALITY OF AIR DEFLECTORS FORMING A PLURALITY OF AIRFLOW ENTRY TUNNELS TO SEQUENTIALLY EXPAND A FLOW CHANNEL OUTWARDLY IN A RADIAL DIRECTION

(71) Applicant: DELTA ELECTRONICS, INC., Taoyuan (TW)

(72) Inventors: Ya-Ting Chang, Taoyuan (TW); Hsiang-Jung Huang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 16/434,442

(22) Filed: Jun. 7, 2019

(65) Prior Publication Data

US 2019/0285075 A1 Sep. 19, 2019

Related U.S. Application Data

(63) Continuation-in-part of application No. 14/734,654, filed on Jun. 9, 2015, now abandoned.

(30) Foreign Application Priority Data

Nov. 25, 2014 (CN) ..... 2014 1 0689760

(51) Int. Cl.
*F04D 25/06* (2006.01)
*F04D 29/42* (2006.01)
(Continued)

(52) U.S. Cl.
CPC ..... *F04D 25/0613* (2013.01); *F04D 29/281* (2013.01); *F04D 29/4226* (2013.01);
(Continued)

(58) Field of Classification Search
CPC ..... H05K 7/20172; G06F 1/203; F04D 29/42; F04D 29/424; F04D 29/70;
(Continued)

(56) References Cited

U.S. PATENT DOCUMENTS 2,050,523 A * 8/1936 Freed ..... F04D 29/441 415/98
2,703,199 A 3/1955 Drake
(Continued)

*Primary Examiner* — Devon C Kramer
*Assistant Examiner* — Benjamin Doyle
(74) *Attorney, Agent, or Firm* — Muncy, Geissler, Olds & Lowe, P.C.

(57) ABSTRACT

A centrifugal fan includes an impeller, a motor and a fan frame. The motor is connected with the impeller and configured to drive the impeller. The fan frame includes a base plate, a top plate, a sidewall and air deflectors. The impeller is disposed between the base plate and the top plate. The sidewall is disposed on the base plate between the base plate and the top plate. A flow channel is between the impeller and the sidewall. The air deflectors are directly connected to the base plate and the top plate, and disposed toward an air outlet and sequentially at different radial positions outwardly from the sidewall along a forward circumferential direction toward an air outlet with respect to the impeller to sequentially expand the flow channel outwardly in a radial direction at different circumferential positions along the forward circumferential direction with respect to the impeller. The airflow entry tunnels are formed by the air deflectors between the base plate and the top plate.

17 Claims, 15 Drawing Sheets

(51) Int. Cl.
*F04D 29/28* (2006.01)
*F04D 29/62* (2006.01)

(52) U.S. Cl.
CPC ..... *F04D 29/626* (2013.01); *F05B 2240/14* (2013.01); *F05B 2240/20* (2013.01)

(58) Field of Classification Search
CPC .. F04D 29/4226; F04D 29/68; F04D 29/4206; F04D 29/4213; F04D 29/684; F04D 29/4253
USPC ..... 417/423.14; 415/206, 208.2
See application file for complete search history.

(56) References Cited

U.S. PATENT DOCUMENTS 3,201,032 A 8/1965 Gelbard
3,592,260 A 7/1971 Berger
3,796,511 A 3/1974 Hansen
5,867,365 A 2/1999 Chiou
6,111,748 A 8/2000 Bhatia
6,132,170 A 10/2000 Horng
6,179,561 B1 1/2001 Horng
6,421,239 B1 7/2002 Huang
6,643,129 B2 11/2003 Fujiwara
6,698,505 B2 3/2004 Lopatinsky et al.
6,778,390 B2 8/2004 Michael
7,021,894 B2 4/2006 Lopatinsky et al.
7,071,587 B2 7/2006 Lopatinsky et al.
7,079,394 B2 7/2006 Mok
7,255,532 B2 8/2007 Zheng
7,434,610 B2 10/2008 Hwang et al.
7,573,714 B2 8/2009 Ali
7,813,129 B2 10/2010 Van Der Werff
8,313,284 B2 11/2012 Hirata
8,702,401 B2 4/2014 Horng
8,988,881 B2 3/2015 Koplow
9,295,180 B2 3/2016 Lu
9,433,126 B2 8/2016 Lu
2006/0021735 A1 2/2006 Lopatinsky et al.
2006/0024160 A1 2/2006 Horng et al.
2006/0078423 A1 4/2006 Zheng
2006/0078428 A1 4/2006 Zheng
2011/0097195 A1* 4/2011 Horng ..... F04D 27/004 415/121.2
2013/0071238 A1 3/2013 Lu
2013/0177402 A1 7/2013 Horng et al.
2014/0099197 A1 4/2014 Chen et al.
2014/0119909 A1 5/2014 Chiang
2016/0146216 A1 5/2016 Chang et al.
2016/0177810 A1 6/2016 Gullberg et al.

* cited by examiner

CENTRIFUGAL FAN COMPRISING A SIDEWALL AND PLURALITY OF AIR DEFLECTORS FORMING A PLURALITY OF AIRFLOW ENTRY TUNNELS TO SEQUENTIALLY EXPAND A FLOW CHANNEL OUTWARDLY IN A RADIAL DIRECTION

CROSS REFERENCE TO RELATED APPLICATIONS

This Non-provisional application is a Continuation-In-Part application of U.S. application Ser. No. 14/734,654, which claims priority to 201410689760.8 filed in People's Republic of China on Nov. 25, 2014, the entire contents of which are hereby incorporated by reference.

BACKGROUND OF THE INVENTION

Field of Invention

The disclosure is relative to a centrifugal fan, especially relative to a centrifugal fan for increasing the input air and with stable output air.

Related Art

In recent years, with advances in technology, the electronic devices (ex: notebook) are gradually developing with high-performance, high speed and high frequency. Accordingly the computing loading of the inside components of the electronic device increases and the temperature of the electronic device is getting higher. If a good heat dissipation solution is not utilized efficiently in the electronic device, the stability will be influenced and the life of the electronic device will be shortened. Thus, generally a fan (ex: centrifugal fan) will be installed inside of the electronic device for heat dissipation.

FIG. 1 is a top view of a prior art centrifugal fan 1. As shown in FIG. 1, the centrifugal fan 1 includes an air outlet O1 and an air inlet (not shown). A sidewall 11 is disposed besides a flow channel P1 of the centrifugal fan 1. The input air is limited to the size and the position of the air inlet. The input air is difficult to increase. Additionally, the centrifugal fan 1 has a non-uniform problem that the output air is collected at the strong wind area H.

Recently the most electronic devices are developed to have a thinner size. The thinner size of the electronic devices will decrease the inner space of the electronic devices. Accordingly, it is an important subject to provide a centrifugal fan with an increasing input air and a stable/uniform output air in the same fan volume.

In US publication 2013/0071238, with reference to FIGS. 1A and 1B, an auxiliary flow 102 is guided by the guiding grooves 127, and enters the housing 120 through the auxiliary inlets 124. Each guiding groove 127 comprises an inclined guiding slope 128 and a guiding sheet 125. The guiding groove 127 with its guiding sheet 125 are purposely only located at the upper plate 120T, so the involute sidewall 123 does not need additionally expanding its width outwardly in radial direction. Thus, the guiding groove 127 and the guiding sheet 125 would not be modified to be directly connected to the lower plate 120B because such modification results in that the auxiliary flow 102 through the auxiliary inlet 124 obstruct the major flow 101.

In U.S. Pat. No. 2,050,523, the air inlets 15 are provided in the top of hood member 8 adjacent the forward portion thereof, but the extending louver boards 16 are not toward the discharge opening 11.

SUMMARY OF THE INVENTION

In view of foregoing subject, an objective of the present disclosure is to provide a centrifugal fan with an increasing input air and a stable/uniform output air in the unchanged volume of the fan.

The disclosure discloses a centrifugal fan including an impeller, a motor and a fan frame. The motor is connected with the impeller and configured to drive the impeller. The fan frame includes a base plate, a top plate, a sidewall, a plurality of air deflectors and a plurality of airflow entry tunnels. The impeller is disposed between the base plate and the top plate. The sidewall is disposed on the base plate between the base plate and the top plate. A flow channel is between the impeller and the sidewall. The air deflectors are directly connected to the base plate and the top plate, and separately disposed toward an air outlet and sequentially at different radial positions outwardly from the sidewall along a forward circumferential direction toward an air outlet with respect to the impeller to sequentially expand the flow channel outwardly in a radial direction at different circumferential positions along the forward circumferential direction with respect to the impeller. The airflow entry tunnels are formed by the air deflectors between the base plate and the top plate.

In one embodiment, the two adjacent air deflectors are overlapped by a non-zero overlapping length along the forward circumferential direction so that the two adjacent air deflectors, the base plate and the top plate firm one of the airflow entry tunnels. One of the air deflectors and the sidewall are overlapped by a non-zero overlapping length along the forward circumferential direction so that the one of the air deflectors, the sidewall, the base plate and the top plate form one of the airflow entry tunnel.

In one embodiment, two ends of one the airflow entry tunnels have a same height with respect to the base plate. Two ends of one the air deflectors have a same height with respect to the base plate.

In one embodiment, two ends of one of the air deflectors have a same distance to the impeller.

In one embodiment, the one of the air deflectors is arc-shaped and its arc center is at the impeller.

In one embodiment, the air outlet and an opposite point are respectively at two opposite sides of the impeller, and a forward included angle between the opposite point and a forward end of the sidewall is between 15 degrees and 60 degrees.

In one embodiment, the forward included angle is 50 degrees.

In one embodiment, a pressurization area is from the air outlet through the opposite point to a forward end of the sidewall along the sidewall, and a combinational air input area is from the forward end of the sidewall to the air outlet along the air deflectors.

In one embodiment, a normal line of the air outlet is toward through a rotation center of the impeller, and the opposite point is at the normal line.

In one embodiment, an included angle from the air deflector which is closest to the sidewall to the normal line of the air outlet along the forward circumferential direction with respect to the impeller is between 120 degrees and 165 degrees.

In one embodiment, an included angle from an entry opening of the airflow entry tunnel which is closest to the air outlet to the normal line of the air outlet along the forward circumferential direction with respect to the impeller is below 90 degrees.

In one embodiment, the flow channel comprises circumferential sections from the impeller outwardly, the innermost section of the circumferential sections is defined within a reference circumferential position at which the sidewall is, other sections of the circumferential sections are respectively defined within the circumferential positions at which the air deflectors are, and the innermost section does not overlap the other sections in a direction from the base plate to the top plate.

In one embodiment, outside airflows flow into the other sections via the airflow entry tunnels.

In one embodiment, the sidewall comprises a throat part, and the air deflectors and the throat part are disposed at two opposite sides of the impeller, respectively.

In one embodiment, dusts in the centrifugal fan are exhausted from the centrifugal fan via the airflow entry tunnels when the impeller is driven to rotate reversely by the motor.

In one embodiment, the air deflectors are discrete sidewalls of the fan frame.

In one embodiment, the base plate and the top plate do not protrude from the air deflectors.

In one embodiment, an included angle between the air outlet and the air deflector which is closest to the sidewall along the forward circumferential direction with respect to the impeller is between 120 degrees and 165 degrees.

The disclosure discloses a centrifugal fan including an impeller, a motor and a fan frame. The motor is connected with the impeller and configured to drive the impeller. The fan frame includes a base plate, a top plate, a sidewall, a plurality of air deflectors and a plurality of airflow entry tunnels. The impeller is disposed between the base plate and the top plate. The sidewall is disposed on the base plate between the base plate and the top plate. A flow channel is between the impeller and the sidewall. The air deflectors are directly connected to the base plate and the top plate, and separately disposed toward an air outlet and sequentially at different radial positions outwardly from the sidewall along a forward circumferential direction toward an air outlet with respect to the impeller to sequentially expand the flow channel outwardly in a radial direction at different circumferential positions along the forward circumferential direction with respect to the impeller. The airflow entry tunnels are formed by the air deflectors between the base plate and the top plate. The air outlet and an opposite point are respectively at two opposite sides of the impeller. A forward included angle between the opposite point and a forward end of the sidewall is between 15 degrees and 60 degrees. An included angle from an entry opening of the airflow entry tunnel which is closest to the air outlet to the normal line of the air outlet along the forward circumferential direction with respect to the impeller is below 90 degrees.

The disclosure discloses a centrifugal fan including an impeller, a motor and a fan frame. The motor is connected with the impeller and configured to drive the impeller. The fan frame includes a base plate, a top plate, a sidewall, a plurality of air deflectors and a plurality of airflow entry tunnels. The impeller is disposed between the base plate and the top plate. The sidewall is disposed on the base plate between the base plate and the top plate. A flow channel is between the impeller and the sidewall. The air deflectors are directly connected to the base plate and the top plate, and separately disposed toward an air outlet and sequentially at different radial positions outwardly from the sidewall along a forward circumferential direction toward an air outlet with respect to the impeller to sequentially expand the flow channel outwardly in a radial direction at different circumferential positions along the forward circumferential direction with respect to the impeller. The airflow entry tunnels are formed by the air deflectors between the base plate and the top plate. The air outlet and an opposite point are respectively at two opposite sides of the impeller. A forward included angle between the opposite point and a forward end of the sidewall is between 15 degrees and 60 degrees. A pressurization area is from the air outlet through the opposite point to a forward end of the sidewall along the sidewall. A combinational air input area is from the forward end of the sidewall to the air outlet along the air deflectors. The air deflectors are discrete sidewalls of the fan frame, and the base plate and the top plate do not protrude from the air deflectors.

According to above, the centrifugal fan of the present disclosure can increase the input air by that air deflectors set separately and along the extension direction along the flow channel and towards to the air outlet and the outside airflow can flow in the fan via the space between the two adjacent air deflectors. Additionally, the airflow flowing into the fan can be flowing along the air deflectors to the air outlet for stable/uniform output air.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
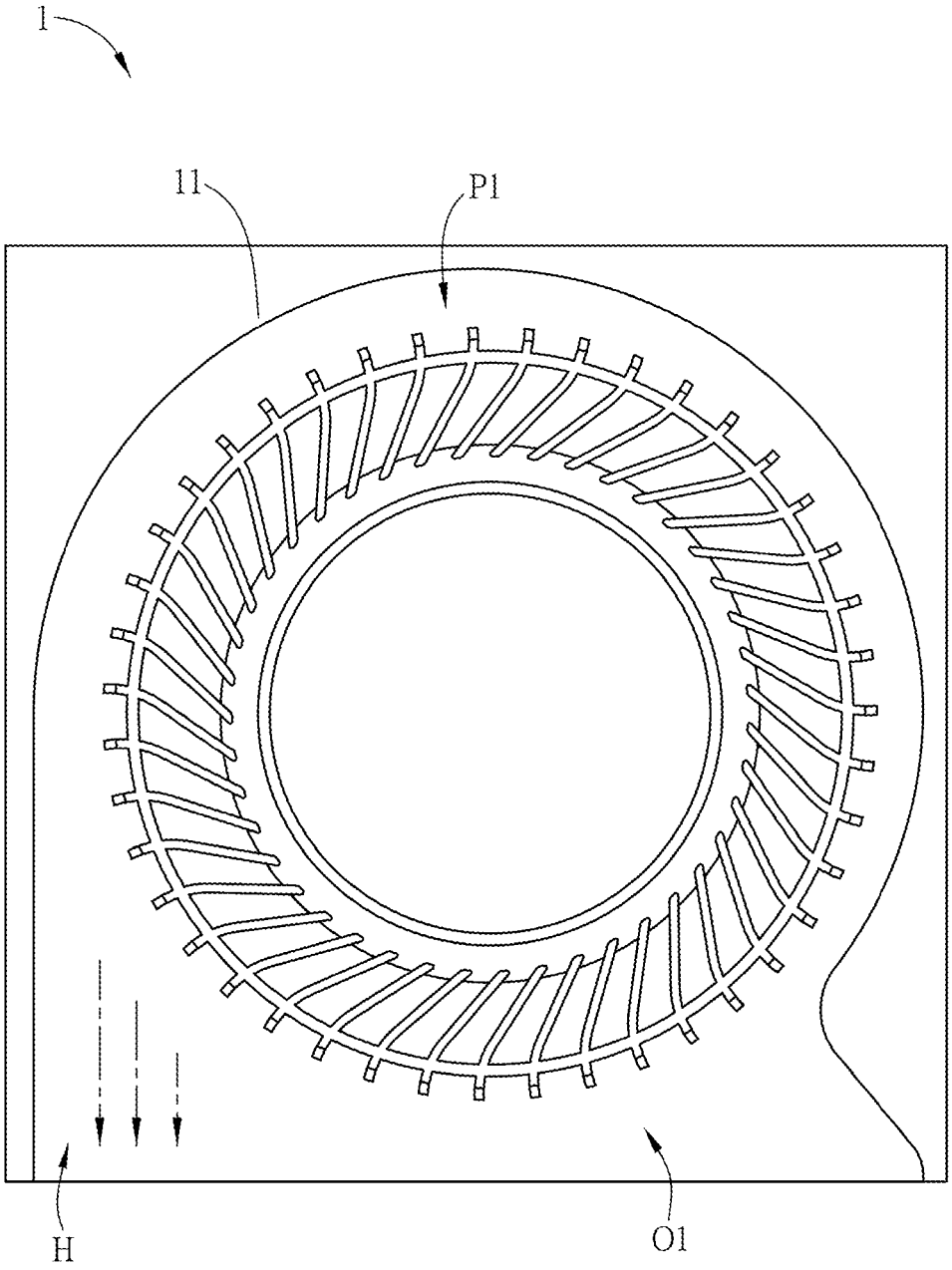
FIG.1 (Prior Art)
FIG. 1 is a top view of a centrifugal fan of the prior art.
Figure 2A:
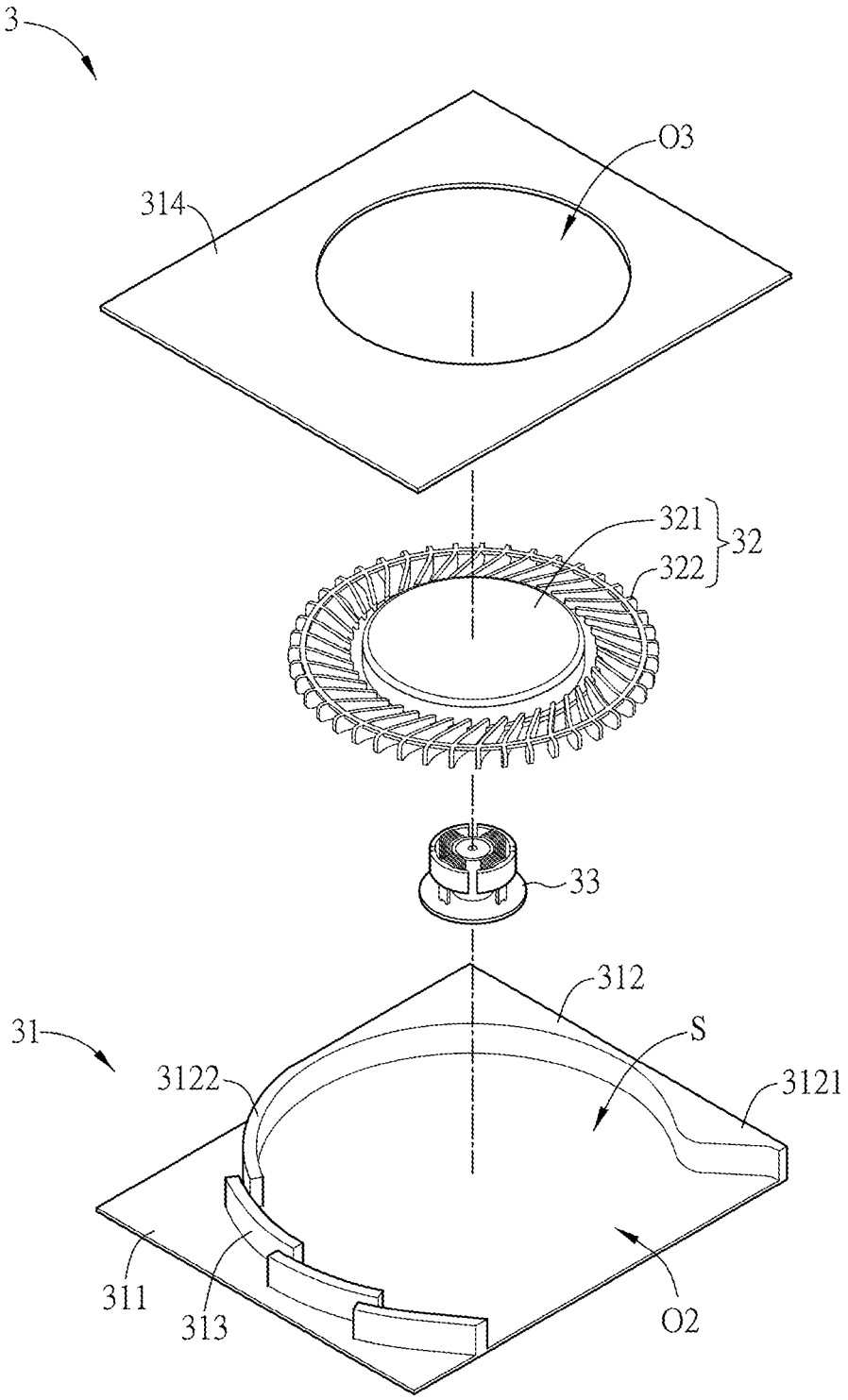
FIG. 2A is an exploded view of a centrifugal fan according to a preferred embodiment of the present disclosure.
Figure 2B:
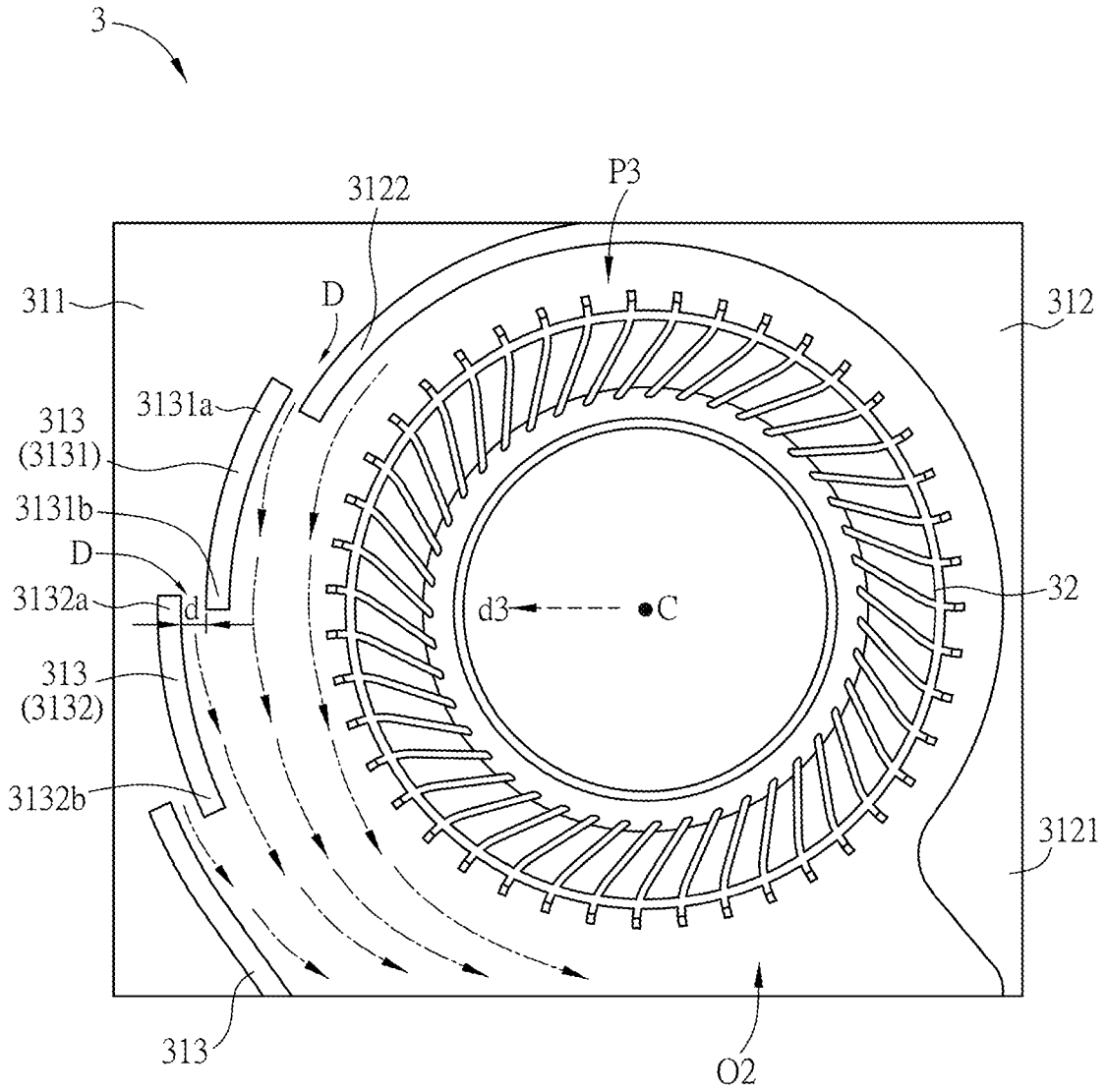
FIG. 2B is a top view of the centrifugal fan in FIG. 2A.

FIG. 2A is an exploded view of a centrifugal fan according to a preferred embodiment of the present disclosure and FIG. 2B is a top view of the centrifugal fan in FIG. 2A. For easily understanding, FIG. 2B does not show the top plate 314 in FIG. 2A. Referring to FIGS. 2A and 2B, the centrifugal fan 3 of this embodiment includes a fan frame 31, an impeller 32 and a motor 33. The centrifugal fan 3 can be received in an electronic device as a heat dissipation system. The electronic device can be a notebook computer.

The fan frame includes a base plate 311, a sidewall 312 and a plurality of air deflectors 313. In the embodiment, the centrifugal fan includes three air deflectors. However, the number of the air deflector can depend on real requirements.

The sidewall 312 and the air deflectors 313 are disposed on the base plate 311. An accommodating space S and an air outlet O2 is disposed by the base plate 311, the sidewall 312 and the air deflectors 313.

The impeller 32 includes a wheel 321 and a plurality of fan blades 322. The impeller is received in the accommodating space S and mounted on the motor 33. The motor is connected with the impeller 32 and drives the impeller 32 to rotate. A flow channel P3 (as shown in FIG. 2B) is disposed between the impeller 32 and the sidewall 312. In the embodiment, the fan frame 31 further includes a top plate 314. An air inlet O3 is disposed in the top plate 314. When the impeller is rotating, the outside air flows into the centrifugal fan 3 via the air inlet O3 and the air in the centrifugal fan 3 flows along the flow channel P3 to the air outlet O2. Then the air in the centrifugal fan 3 is exhausted via the air outlet O2.

In the embodiment, the air deflectors 313 are separately disposed along the extension direction of the flow channel and toward to the air outlet O2. In detail, the sidewall 312 in the embodiment includes a throat part 3121 and a guiding part 3122. The throat part 3121 and the guiding part 3122 are respectively disposed at two ends of the sidewall 312. The air deflectors 313 are separately disposed from the position. adjacent to the guiding part 3122 and toward to the air outlet O2. The air deflectors 313 and the throat part 3121 are disposed on the two sides of the impeller 32. According to that the air deflectors are separately disposed, a gap D is formed between the two adjacent air deflectors 313. In the embodiment, a distance of the gap D optimally is between 0.5 mm to 10 mm. In the embodiment, when the impeller is rotating, outside airflow can flow into the centrifugal fan 3 via the gap D, the air in the centrifugal fan 3 flows along the extension direction of the flow channel P3 for increasing the input air.

In the embodiment, the outside air that flows into the centrifugal fan 3 can be guided to a low air pressure position by the air deflectors 313. In FIG. 2B, the air deflectors 313 are arc-shaped. The outside airflow can be guided to a position near to the middle of the air outlet O2 for the stable/uniform output air around the air outlet O2. It is noted that the shape of the air deflectors can be adjusted according to the real requirements, and it is not limited to shapes of the air deflectors as shown in the figures.

The following descriptions are relative to the relative positions of the air deflectors 313.

In the embodiment, the air deflectors 313 at least include a first air deflector 3131 and a second air deflector 3132. A distance between the second air deflector 3132 and the air outlet O2 is smaller than a distance between the first air deflector 3131 and the air outlet O2. The second air deflector 3132 and the impeller 32 are disposed two opposite sides of the first air deflector 3131.

In detail, the first air deflector 3131 includes a first end 3131*a* and a second end 3131*b*. The second end 3131*b* is disposed adjacent to the second deflector 3132. The second air deflector 3132 includes a third end 3132*a* and a fourth end 3132*b*. The third end 3132 is adjacent to the first air deflector 3131. The third end 3132*a* and the impeller 32 are disposed two opposite sides of the second end 3131*b*. It means that the second air deflector 3132 is located at outside of the first air deflector 3131.

In centrifugal fan 3 according to the embodiment of the present, the position of the air deflector 313 that is closer to the air outlet O2 is disposed farther than the position of the air deflector 313 that is father from the air outlet O2. Therefore, the air deflectors 313 will not decrease the space of the whole flow channel and prevent to decrease the air inside the centrifugal fan.

Additionally, in the embodiment, the two adjacent air deflectors 313 are partially overlapped along a predetermined direction. In FIG. 2B, the first air deflector 3131 and the second air deflector 3132 are partially overlapped in the predetermined direction d3. In detail, the second end 3131*h* of the first air deflector 3131 and the third end of the second air deflector 3132 are overlapped in the predetermined direction d3. The impeller 32 includes a rotation center C. The predetermined direction d3 is a direction from the rotation center C to the second end 3131*b*. Thus, when the impeller 32 rotates forwardly, the air in the centrifugal fan 3 exhausted via the gap D between the air deflector 3131 and the second air deflector 3132 can be prevented.

In the embodiment, the gap D is also disposed between the first end 3131*a* of the first air deflector 3131 and the guiding part 3122. The gap D is utilized for increasing the input air. The distance between the first air deflector 3131 and the impeller 32 is larger than the distance between the sidewall 312 and the impeller 32. Accordingly the space of the flow channel will not be decreased by the first air deflector 3131.

The distance between the sidewall 312 and the impeller 32, the distance between the first air deflector 3131 and the impeller 32, and the distance between second air deflector 3132 and the impeller 32 are increasing in turn. A width of the flow channel is larger increasingly. There is enough space that the outside airflow can flow via the gap D for increasing the air in the centrifugal fan 3.

Additionally, in the embodiment, when the motor drives the impeller 32 to rotate reversely, a reverse airflow is generated in the centrifugal fan 3. Dusts in the centrifugal fan 3 can be exhausted from the centrifugal fan 3 via the gap D between the two adjacent air deflectors to achieve the dust-removing function. A shape of the air deflectors 313 is arc-shaped to match the flow direction of the flow field. The dusts in the centrifugal fan 3 can be flowed along the arc-shaped air deflector and exhausted via the gap D.

Figure 2C:
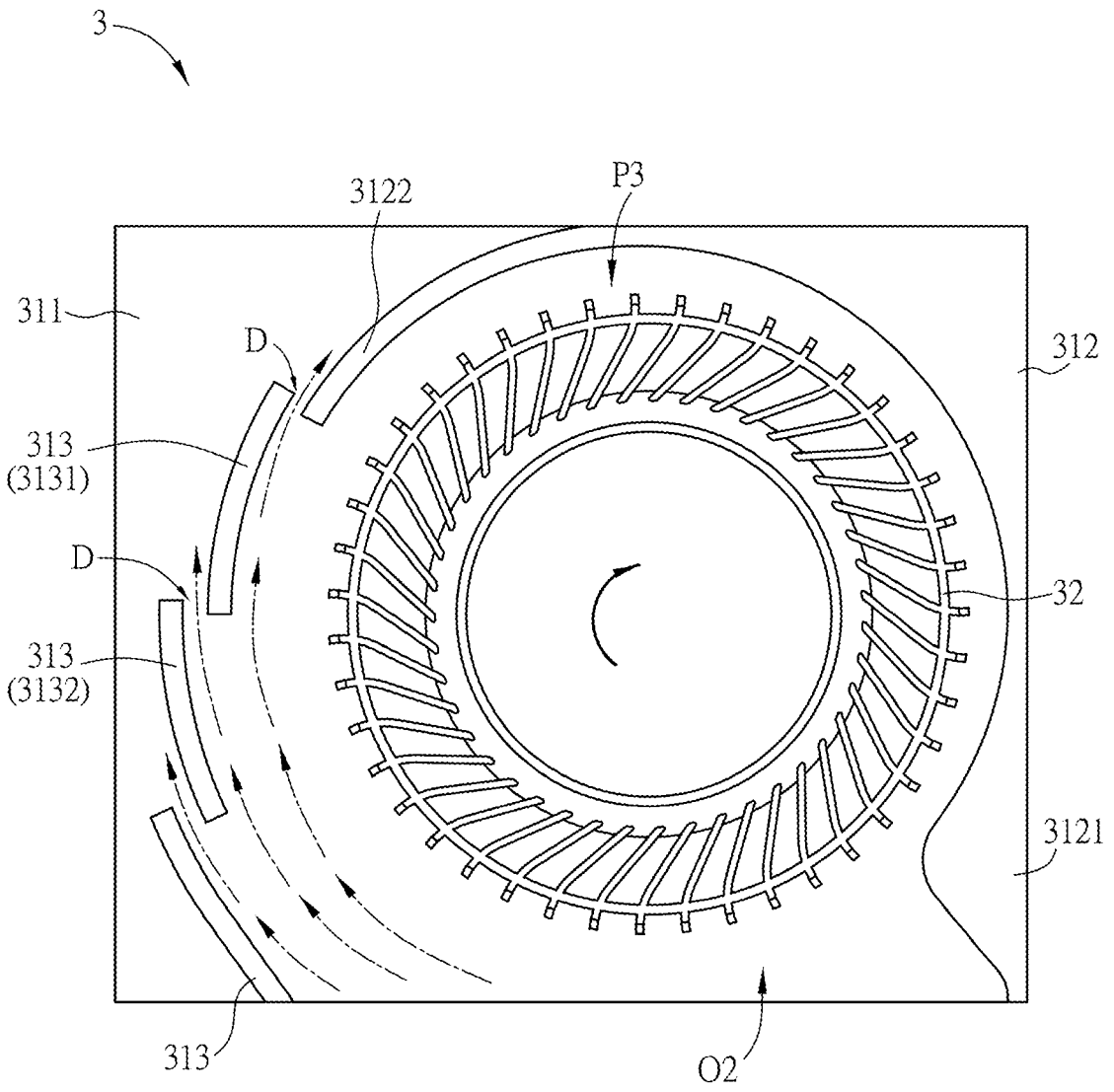
FIG. 2C is a schematic diagram when the centrifugal fan reversely rotates.
Figure 2D:
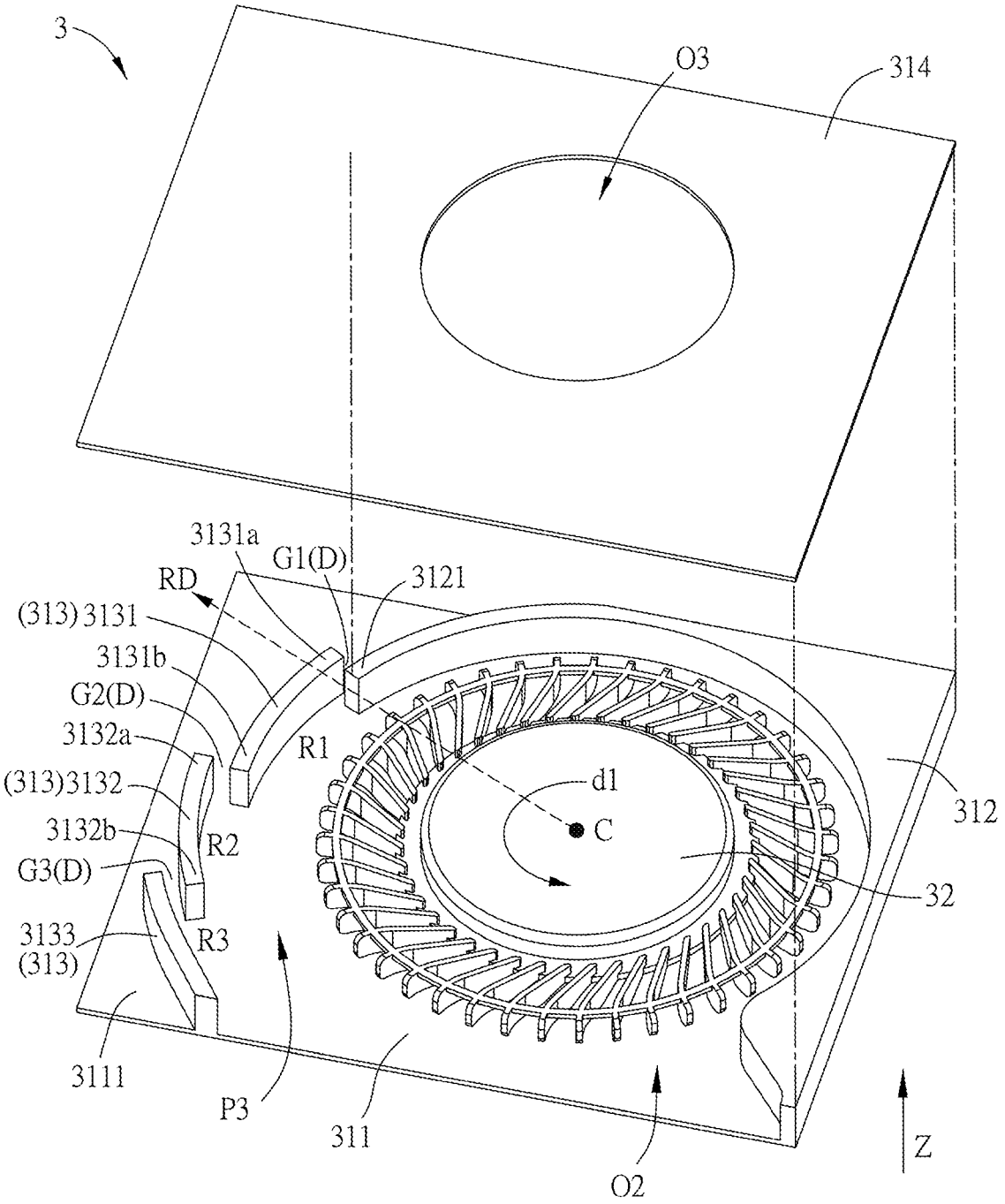
FIGS. 2D-2F are perspective diagrams showing the centrifugal fan in FIGS. 2A-2C.
Figure 2E:
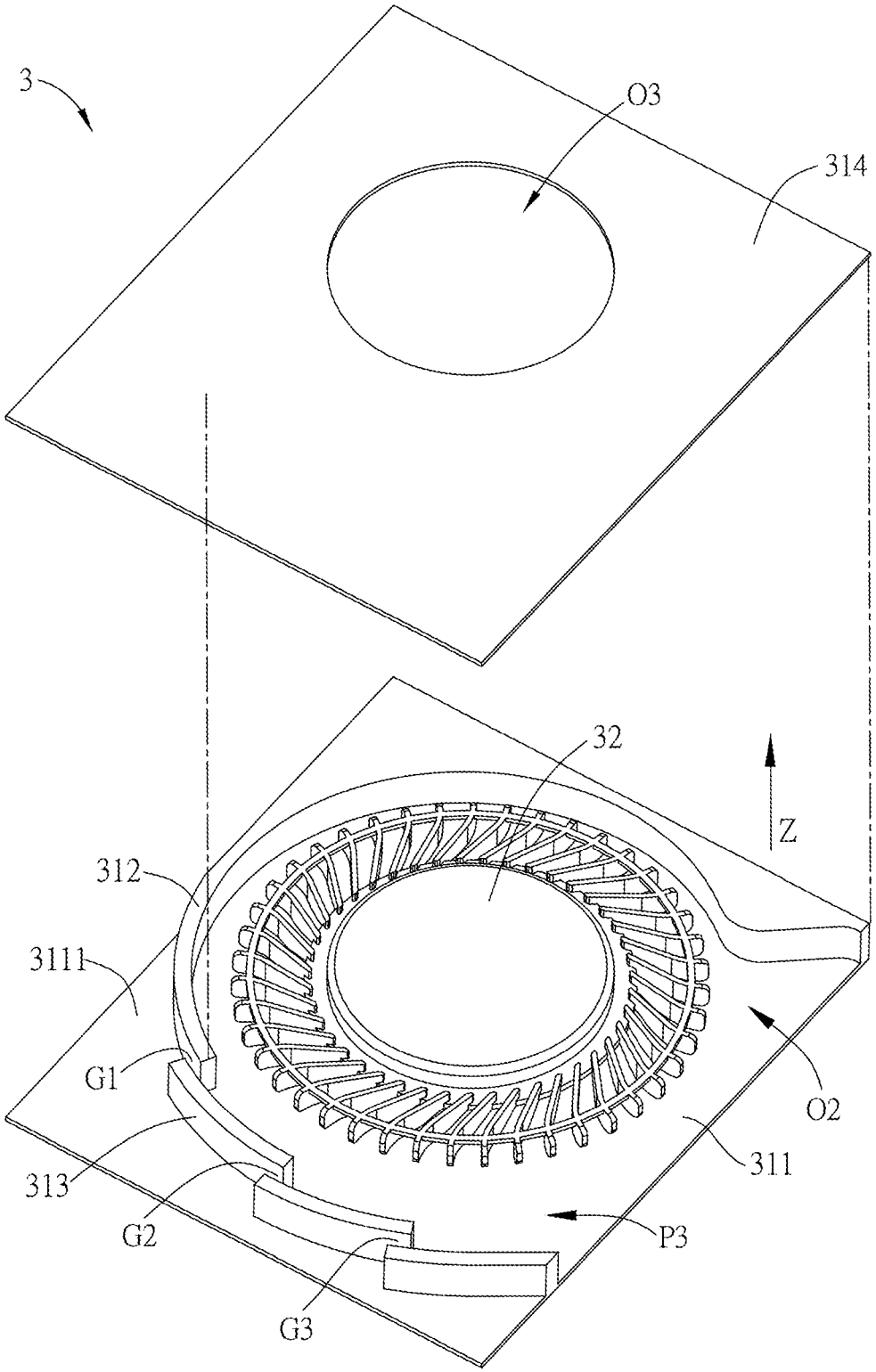
Figure 2F:
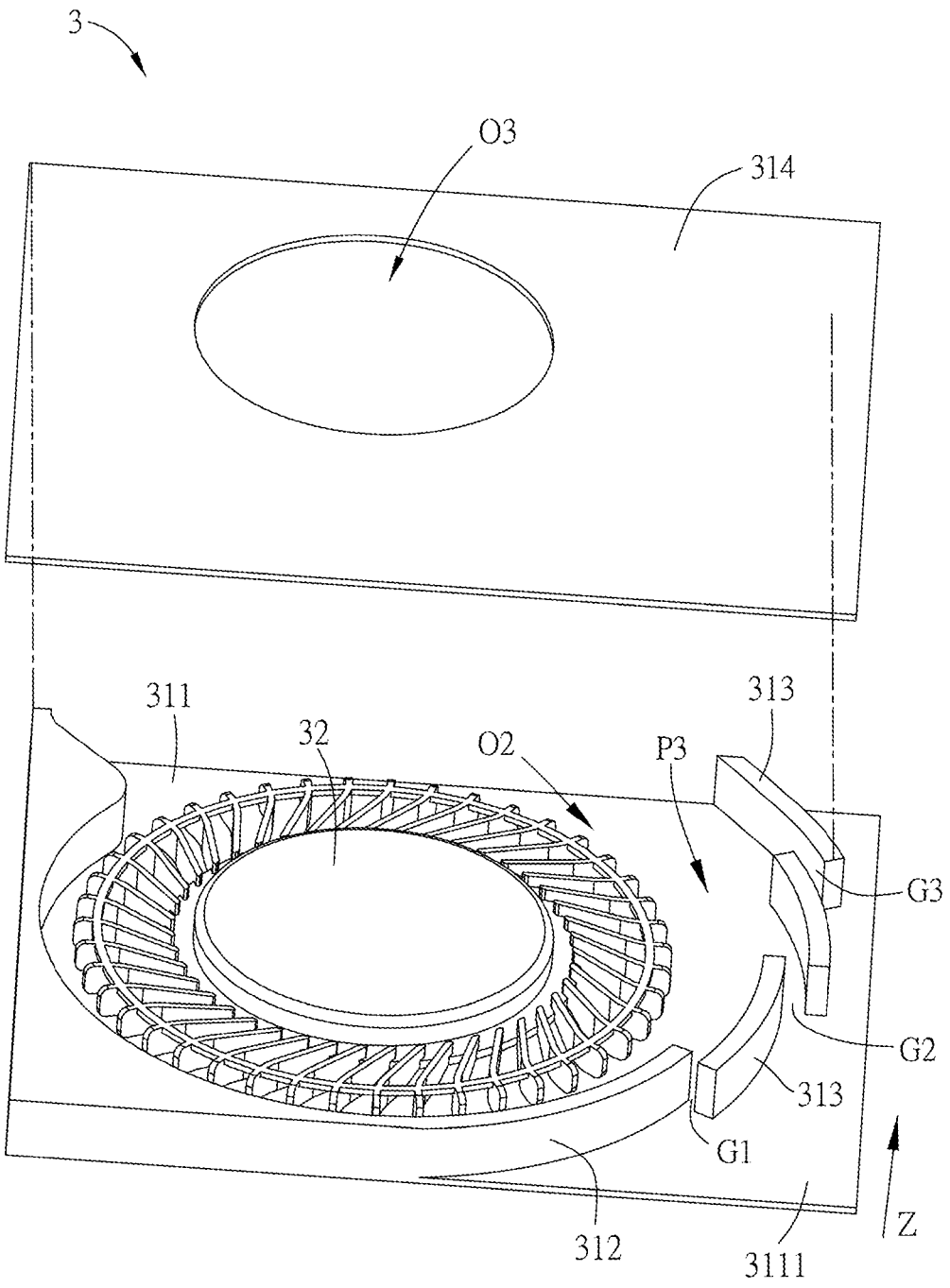
Figure 2G:
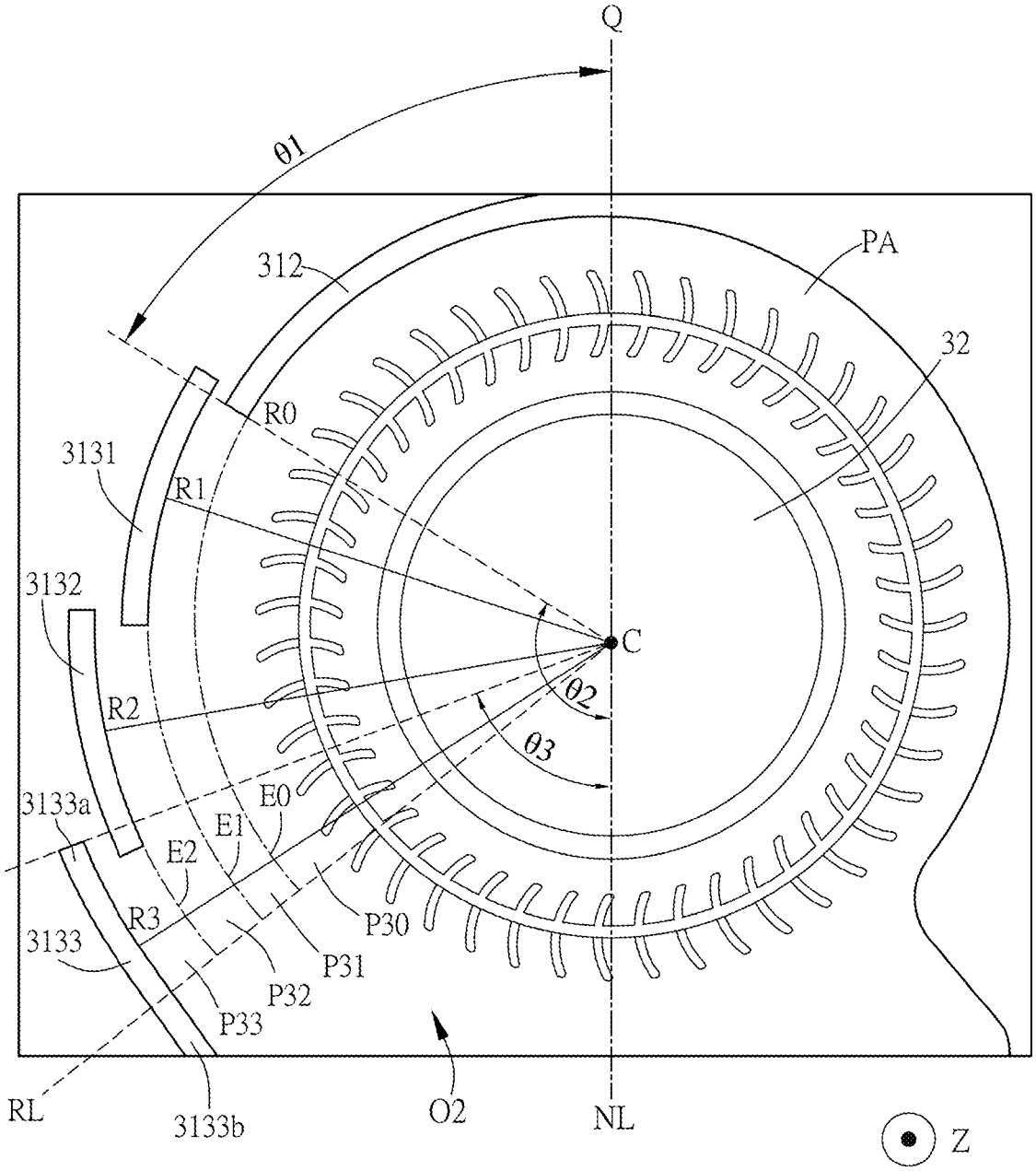
FIG. 2G is a schematic diagram showing the centrifugal fan in FIGS. 2A-2C.

FIGS. 2D-2F are perspective diagrams showing the centrifugal fan 3 in FIGS. 2A-2C. FIG. 2G is a schematic diagram showing the centrifugal fan 3 in FIGS. 2A-2C. In FIGS. 2A-2G, the impeller 32 is disposed between the base plate 311 and the top plate 314. The sidewall 312 is between the base plate 311 and the top plate 314. The air deflectors 313 are directly connected to the base plate 311 and the top plate 314, and separately disposed toward the air outlet O2 and sequentially at different radial positions R1~R3 outwardly from the sidewall 312 along a forward circumferential direction d1 toward the air outlet with respect to the impeller 32 to sequentially expand the flow channel P3 outwardly in a radial direction RD at different circumferential positions R1~R3 along the forward circumferential direction d1 with respect to the impeller 32. The airflow entry tunnels G1~G3 are formed by the air deflectors 313 between the base plate 311 and the top plate 314.

The two adjacent air deflectors 3131, 3132 are overlapped by a non-zero overlapping length along the forward circumferential direction d1 so that the two adjacent air deflectors 3131, 3132, the base plate 311 and the top plate 314 form one airflow entry tunnel G2. The airflow entry tunnel G2 is at the gap D and extended from the third end 3132*a* of the air deflector 3132 to the second end 3131*b* of the air deflector 3131 along the forward circumferential direction d1. The distance from the third end 3132*a* of the air deflector 3132 to the second end 3131*b* of the air deflector 3131 along the forward circumferential direction d1 is greater than 0. The airflow entry tunnel G3 is similar or same with the airflow entry tunnel G2. Further, one of the air deflectors 311 (air deflector 3131) and the sidewall 312 are overlapped by a non-zero overlapping length along the forward circumferential direction d1 so that the air deflectors 3131, the sidewall 312, the base plate 311 and the top plate 314 form the airflow entry tunnel G1. The airflow entry tunnel G1 is at the gap D and extended from the first end 3131*a* of the air deflector 3131 to a forward end 3121 of the sidewall 312 along the forward circumferential direction d1. The distance from the first end 3131*a* of the air deflector 3131 to the forward end 3121 of the sidewall 312 along the forward circumferential direction d1 is greater than 0.

A height of the air deflectors 313 is equal to a height of the airflow entry tunnels G1~G3 with respect to the base plate 311. Regarding one air deflector 313, for example the air deflector 3131, its two ends 3131*a*, 3131*b* have a same height with respect to the base plate 311. For example, the air deflector 3131 has an equal height from one end 3131*a* to the other end 3131*b*. The air deflectors 3132, 3133 are similar or same with the air deflector 3131. Two ends of the airflow entry tunnel G2 have a same height with respect to the base plate 311. The airflow entry tunnel G2 has an equal height from the third end 3132*a* to the second end 3131*b*. The airflow entry tunnels G1 and G3 are similar or same with the airflow entry tunnel G2. Further, the width of the airflow entry tunnels G1 and G3 is between 0.5 mm and 10 mm. The width of the airflow entry tunnels G1 and G3 can remain equal along the forward circumferential direction d1.

In addition, the two ends 3131*a*, 3131*b* of the air deflector 3131 have a same distance to the impeller 32. For example, the air deflector 3131*a* is arc-shaped and its arc center is at the impeller 32. The arc center and the rotation center C may be at the same position. The air deflector 3132 is similar or same with the air deflector 3131. The two ends of the air deflector 3133 have different distances to the impeller 32, but in other embodiment the two ends of the air deflector 3133 can have a same distance to the impeller 32.

In FIG. 2G, the air outlet O2 and an opposite point Q are respectively at two opposite sides of the impeller 32, and a forward included angle θ1 between the opposite point Q and the forward end 3121 (or the air deflector closest to the sidewall 312) is between 15 degrees and 60 degrees. The forward end 3121 (or the air deflector closest to the sidewall 312) is ahead of the opposite point Q by the forward included angle θ1 along the forward circumferential direction d1. For example, the forward included angle θ1 is 50 degrees. A pressurization area PA is from the air outlet O2 through the opposite point Q to the forward end 3121 along the sidewall 312 (along the forward circumferential direction d1), and a combinational air input area is from the forward end 3121 to the air outlet O2 along the air deflectors 313 (along the forward circumferential direction d1). A normal line NL of the air outlet O2 is toward through the rotation center C of the impeller 32, and the opposite point Q is at the normal line NL.

Ahead of the forward end 3121, an included angle θ2 from the air deflector 3131, which is closest to the sidewall 312, to the air outlet O2 or the normal line NL along the forward circumferential direction d1 with respect to the impeller 32 is between 120 degrees and 165 degrees. The forward included angle θ1 and the included angle θ2 are supplementary angles. An included angle θ3 from an entry opening of the airflow entry tunnel G3, which is closest to the air outlet O2, to the normal line NL along the forward circumferential direction d1 with respect to the impeller 32 is below 90 degrees.

The flow channel P3 comprises circumferential sections P30~P33 from the impeller 32 outwardly. The innermost section P30 of the circumferential sections is defined within a reference circumferential position R0 at which the sidewall 312 is. Other sections P31~P33 of the circumferential sections are respectively defined within the circumferential positions R1~R3 at which the air deflectors 3131~3133 are. An extension arc line E0 by a radius (from the rotation center C to the reference circumferential position R0) is extended from the forward end 3121 along the forward circumferential direction d1. Extension arc lines E1, E2 by radii (from the rotation center C respectively to the reference circumferential positions R1, R2) are extended from the air deflectors 3131, 3132 along the forward circumferential direction d1 to a reference line RL. The extension arc lines E0~E2 do not intersect. The innermost section P30 is within the extension arc line E0 and does not overlap the other sections P31~P33 in a direction Z from the base plate 311 to the top plate 314. The section P31 is between the extension arc lines E0, E1 and the air deflector 3131. The sections P32~P33 are similar to the section P31. The other sections P31~P33 also do not overlap each other in the direction Z. Viewing along the direction Z from top, the sections P31~P33 are covered by the top plate 314. The air inlet O3 of the top plate 314 is connected to the innermost section P30. The innermost section P30 is partially covered by the top plate 314. The sections P31~P33 and part of the innermost section P30 are at the combinational air input area.

In addition, the air deflector 3133 can have an arc section 3133*a* and a straight section 3133*b*. Along the forward circumferential direction d1, the arc section 3133*a* is following the reference line RL, and the straight section 3133*b* is ahead of the reference line RL. The arc center of the arc section 3133*a* is at the impeller 32. The air deflectors 3131, 3132 and the arc section 3133*a* have the same arc center at the rotation center C.

The full heights of sections P30~P33 are from the base plate 311 to the top plate 314 and remain unchanged from the forward end 3121 to the air outlet O2. The full heights of the airflow entry tunnels G1~G3 are from the base plate 311 to the top plate 314 and remain unchanged along the forward circumferential direction d1. The heights of the sections P30~P33 and the airflow entry tunnels G1~G3 are equal.

Outside airflows flow into the other sections P31~P33 via the airflow entry tunnels G1~G3. The outside airflows through the airflow entry tunnels G1~G3 would not interfere with air pressurization at the pressurization area PA. Further, dusts in the centrifugal fan 3 can be exhausted from the centrifugal fan 3 via the airflow entry tunnels G1~G3 when the impeller is driven to rotate reversely (the forward circumferential direction d1 in reverse) by the motor.

Figure 3:
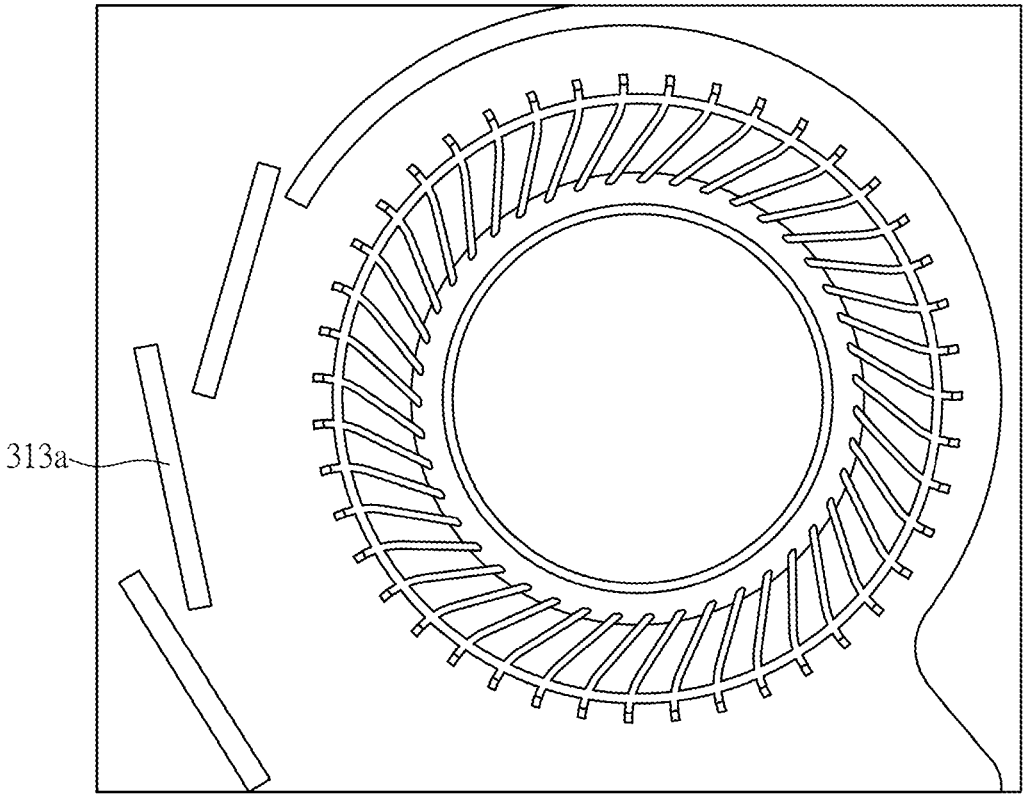
FIG. 3 is a schematic diagram of different types of air deflector of the present disclosure.

Referring to FIG. 3, FIG. 3 is a schematic diagram of different types of air deflector of the present disclosure. Different from the air deflectors 313 in FIGS. 2A-2G, a shape of air deflectors 313*a* in FIG. 3 is similar to a rectangle in a top view. Other characters of the centrifugal fan 3 in FIG. 3 are similar to that of the centrifugal fan 3 in FIGS. 2A-2G. Please referring the preceding paragraphs and they are not repeated again.

Figure 4A:
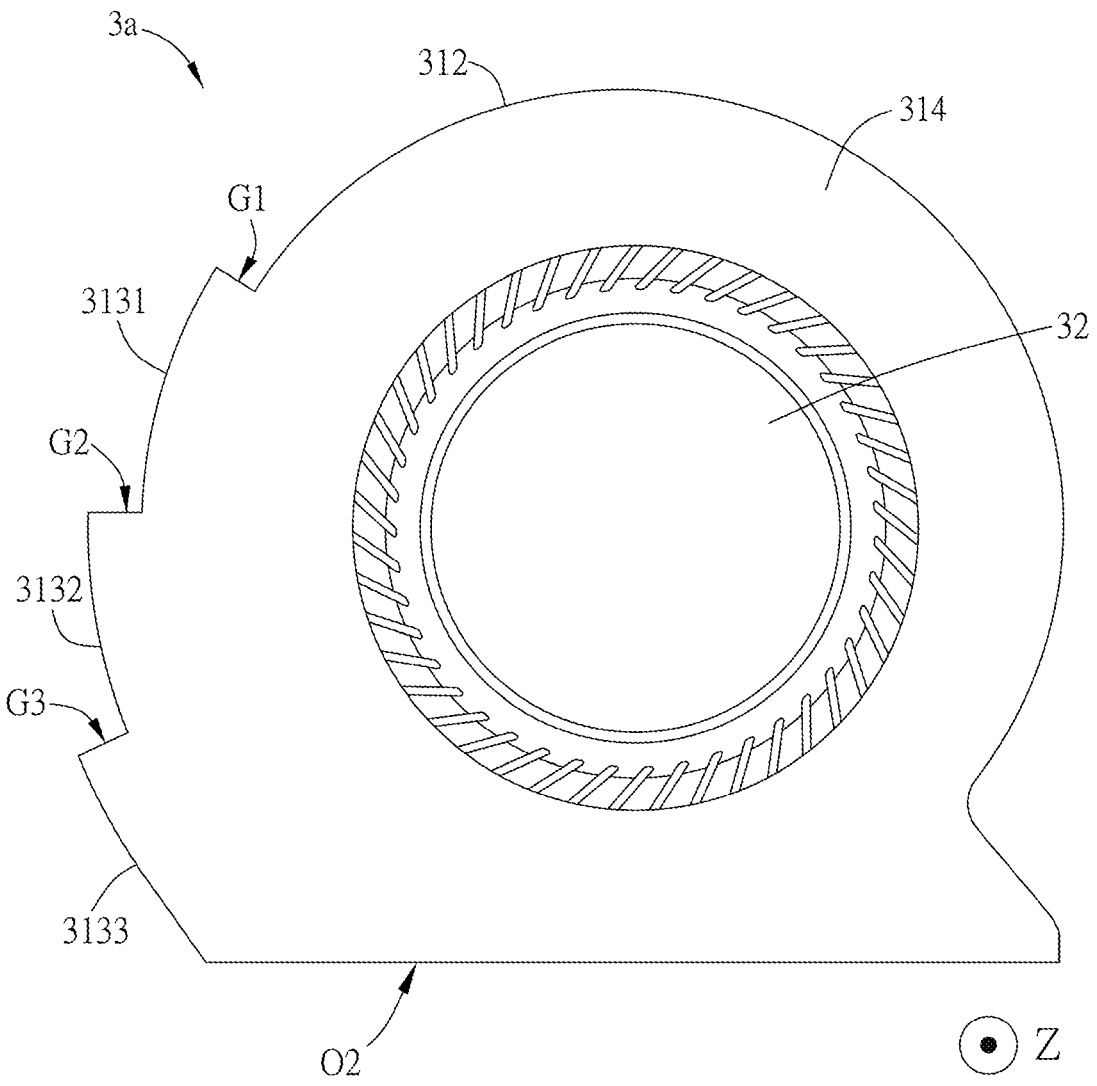
FIGS. 4A-4B are schematic diagrams showing a centrifugal fan.
Figure 4B:
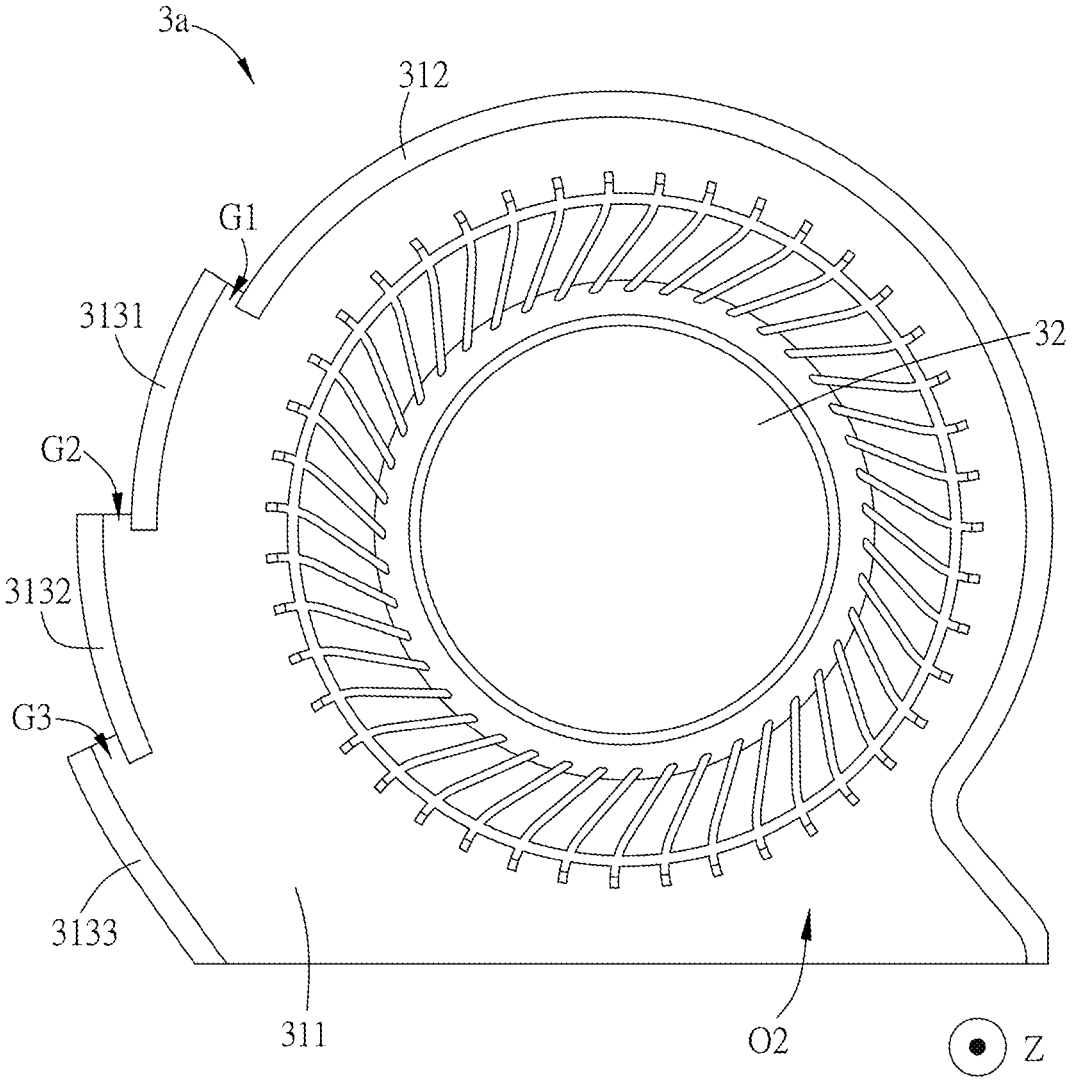
Figure 4C:
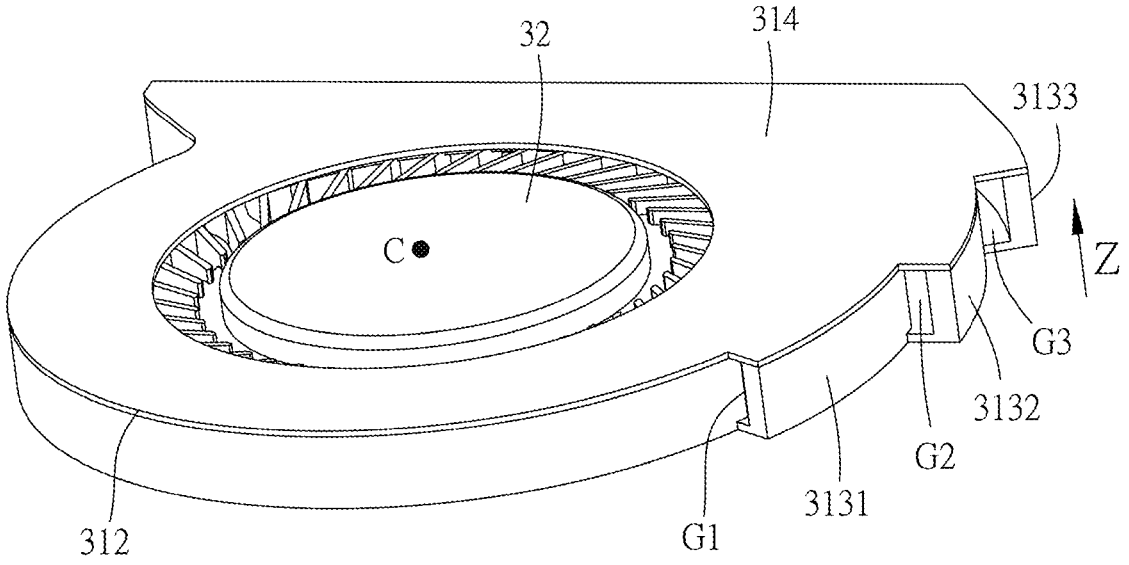
FIGS. 4C-4F are perspective diagrams showing the centrifugal fan in FIGS. 4A-4B.
Figure 4D:
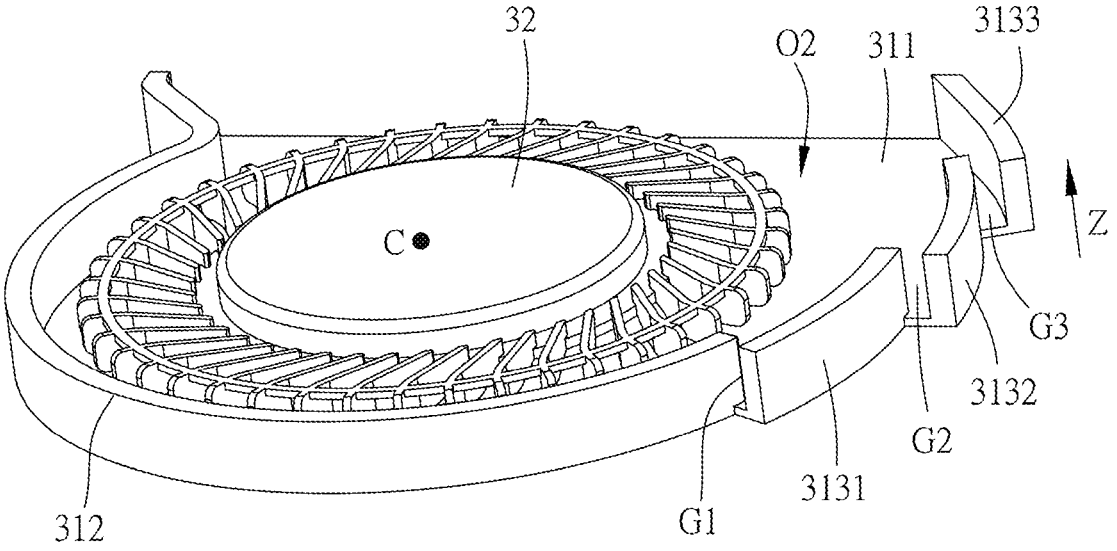
Figure 4E:
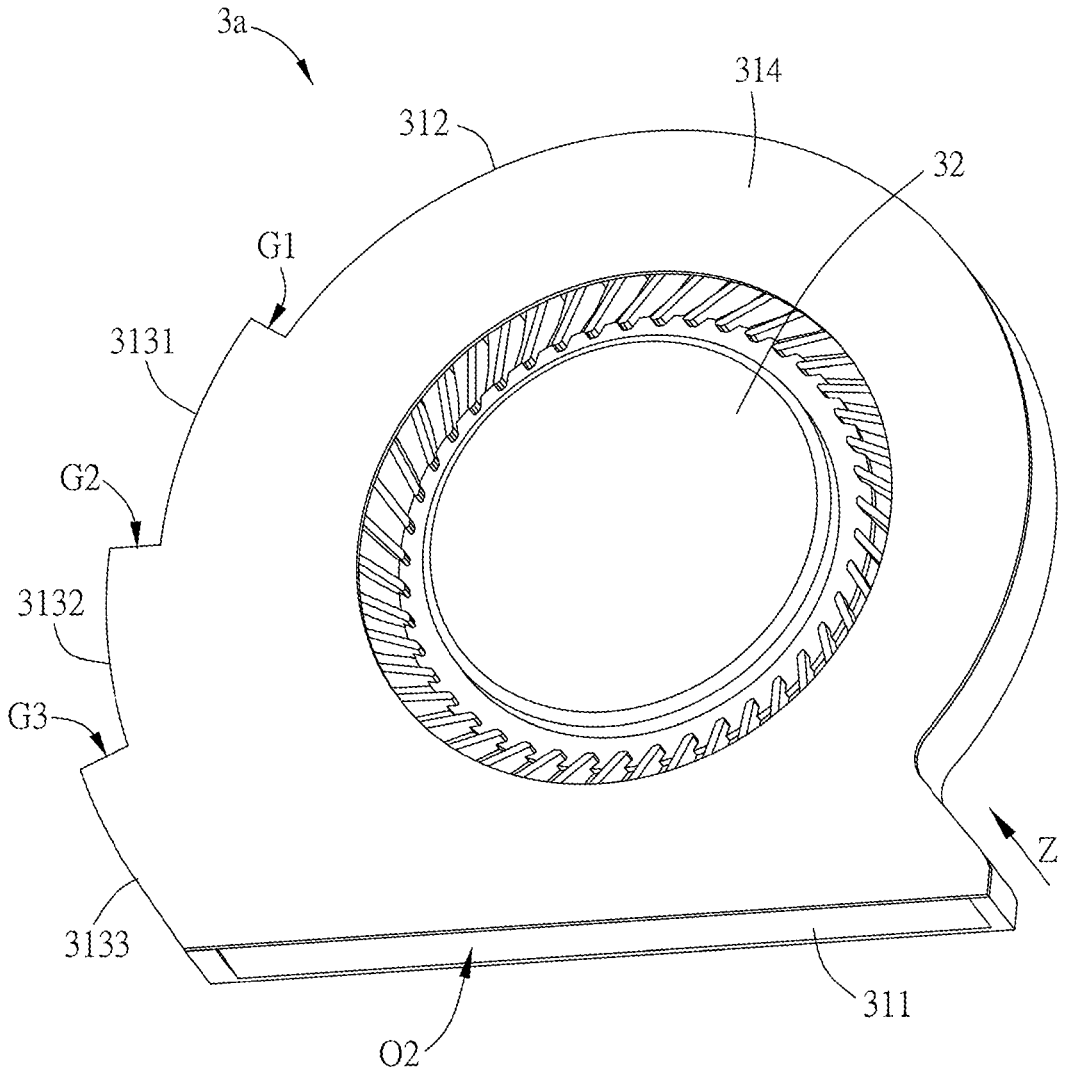
Figure 4F:
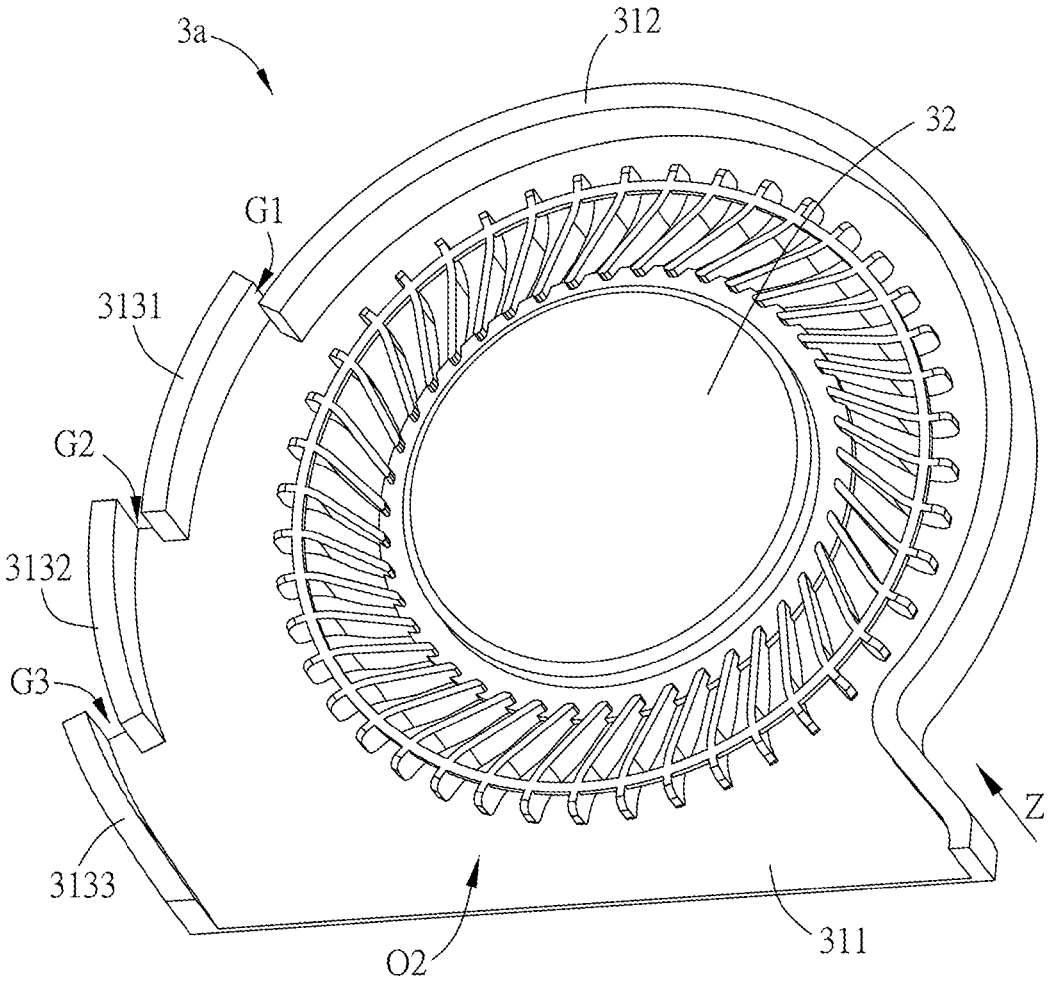

FIGS. 4A-4B are schematic diagrams showing a centrifugal fan 3*a*. FIG. 4A shows the appearance of the centrifugal fan 3*a* when viewing from top. FIG. 4B shows the interior of the centrifugal fan 3*a* in FIG. 4A. FIGS. 4C-4F are perspective diagrams showing the centrifugal fan 3*a* in FIGS. 4A-4B. FIG. 4C shows the appearance of the centrifugal fan 3*a*, and FIG. 4D shows the interior of the centrifugal fan 3*a* in FIG. 4C. FIG. 4E shows the appearance of the centrifugal fan 3*a*, and FIG. 4F shows the interior of the centrifugal fan 3*a* in FIG. 4E. In FIGS. 4A-4F, the air deflectors 313 are discrete sidewalls of the fan frame 31. The base plate 311 and the top plate 314 do not protrude from the air deflectors 313. The centrifugal fan 3*a* in FIGS. 4A-4F can be obtained by modifying the centrifugal fan 3 in FIGS. 2A-2G. The modification includes removing the portion 3111 of the base plate 311 in FIGS. 2A-2G and modifying the sidewall 312 in FIGS. 2A-2G into plate shape.

In summary, in the centrifugal fan, the air deflectors are disposed separately along the extension direction and toward to the air outlet. The outside airflow can flow in the centrifugal fan via the gap between the two adjacent air deflectors. Thus, the input air is increased. Additionally, the inside airflow can flow along the air deflectors to the air outlet for unifying the output air.

Comparing to the prior art, the flow channel of the centrifugal fan is not reduced according to the air deflectors. The centrifugal fan can overcome the problem that the air pressure in the fan is not uniform and noisy. Additionally, the dust in the fan can be exhausted easily, and is not accumulated in the gap.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A centrifugal fan comprising:

an impeller;

a motor connected with the impeller and configured to drive the impeller;

a fan frame comprising:

a base plate;

a top plate, wherein the impeller is disposed between the base plate and the top plate;

a sidewall, disposed on the base plate between the base plate and the top plate, wherein a flow channel is between the impeller and the sidewall;

a plurality of air deflectors, directly connected to the base plate and the top plate, separately disposed facing an air outlet and sequentially at different radial positions outwardly from the sidewall along a forward circumferential direction with respect to the impeller to sequentially expand the flow channel outwardly in a radial direction at different circumferential positions along the forward circumferential direction with respect to the impeller; and a plurality of airflow entry tunnels, formed by the air deflectors between the base plate and the top plate;

wherein an included angle is a central angle having a vertex at a rotation center of the impeller, the included angle defined by an arc starting from the air deflector which is closest to the sidewall and extending along the forward circumferential direction, with respect to the impeller, to a normal line of the air outlet passing through the rotation center; wherein the included angle is between 120 and 165 degrees.

2. The centrifugal fan of claim 1, wherein two of the plurality of air deflectors are adjacent air deflectors and are overlapped by a non-zero overlapping length along the forward circumferential direction so that the two adjacent air deflectors, the base plate and the top plate form one of the airflow entry tunnels, wherein one of the air deflectors and the sidewall are overlapped by a non-zero overlapping length along the forward circumferential direction so that the one of the air deflectors, the sidewall, the base plate and the top plate form one of the airflow entry tunnel.

3. The centrifugal fan of claim 1, wherein two ends of one the airflow entry tunnels have a same height with respect to the base plate, and two ends of one the air deflectors have a same height with respect to the base plate.

4. The centrifugal fan of claim 1, wherein two ends of one of the air deflectors have a same distance to the impeller.

5. The centrifugal fan of claim 4, wherein at least one of the air deflectors is arc-shaped and its arc center is at the impeller.

6. The centrifugal fan of claim 1, wherein the air outlet an opposite point are respectively at two opposite sides of the impeller, and a forward included angle is a second central angle having a vertex at the rotation center of the impeller, the forward included angle defined by an arc starting from the opposite point and extending along the forward circumferential direction, with respect to the impeller, to a forward end of the sidewall at one of the airflow entry tunnels, wherein the forward included angle is between 15 and 60 degrees, wherein the opposite point is along the normal line of the air outlet.

7. The centrifugal fan of claim 6, wherein the forward included angle is 50 degrees.

8. The centrifugal fan of claim 6, wherein a pressurization area starts from the air outlet then through the opposite point and finally reaches a forward end of the sidewall along the sidewall and the forward circumferential direction, and a combinational air input area is from the forward end of the sidewall to the air outlet along the air deflectors.

9. The centrifugal fan of claim 1, wherein a second included angle is a third central angle having a vertex at the rotation center of the impeller defined by an arc starting form an entry opening of the airflow entry tunnel which is closest to the air outlet along the forward circumferential direction, with respect to the impeller, and extending to the normal line of the air outlet; wherein the second included angle is below 90 degrees.

10. The centrifugal fan of claim 1, wherein the flow channel comprises circumferential sections from the impeller outwardly, the innermost section of the circumferential sections is defined within a reference circumferential position at which the sidewall is, other sections of the circumferential sections are respectively defined within the circumferential positions at which the air deflectors are, and the innermost section does not overlap the other sections in a direction from the base plate to the top plate.

11. The centrifugal fan of claim 10, wherein outside airflows flow into the other sections via the airflow entry tunnels.

12. The centrifugal fan of claim 1, wherein the sidewall comprises a throat part, and the air deflectors and the throat part are disposed at two opposite sides of the impeller, respectively.

13. The centrifugal fan of claim 1, wherein dusts in the centrifugal fan are exhausted from the centrifugal fan via the airflow entry tunnels when the impeller is driven to rotate reversely by the motor.

14. The centrifugal fan of claim 1, wherein the air deflectors are discrete sidewalls of the fan frame.

15. The centrifugal fan of claim 14, wherein the base plate and the top plate do not protrude from the air deflectors.

16. A centrifugal fan comprising:

an impeller;

a motor connected with the impeller and configured to drive the impeller;

a fan frame comprising:

a base plate;

a top plate, wherein the impeller is disposed between the base plate and the top plate;

a sidewall, disposed on the base plate between the base plate and the top plate, wherein a flow channel is between the impeller and the sidewall;

a plurality of air deflectors, directly connected to the base plate and the top plate, separately disposed facing an air outlet and sequentially at different radial positions outwardly from the sidewall along a forward circumferential direction with respect to the impeller to sequentially expand the flow channel outwardly in a radial direction at different circumferential positions along the forward circumferential direction with respect to the impeller; and a plurality of airflow entry tunnels, formed by the air deflectors between the base plate and the top plate;

wherein the air outlet and an opposite point are respectively at two opposite sides of the impeller, a forward included angle is a central angle having a vertex at a rotation center of the impeller, the included angle defined by an arc starting from the opposite point and extending along the forward circumferential direction, with respect to the impeller, to a forward end of the sidewall at one of the airflow entry tunnels, wherein the forward included angle is between 15 and 60 degrees, wherein an included angle is a second central angle having a vertex at the rotation center of the impeller defined by an arc starting from an entry opening of the airflow entry tunnel which is closest to the air outlet along the forward circumferential direction, with respect to the impeller, and extending to a normal line of the air outlet passing through the rotation center; wherein the second included angle is below 90 degrees; wherein the opposite point is along the normal line of the air outlet.

17. A centrifugal fan comprising:

an impeller;

a motor connected with the impeller and configured to drive the impeller;

a fan frame comprising:

a base plate;

a top plate, wherein the impeller is disposed between the base plate and the top plate;

a sidewall, disposed on the base plate between the base plate and the top plate, wherein a flow channel is between the impeller and the sidewall;

a plurality of air deflectors, directly connected to the base plate and the top plate, separately disposed facing an air outlet and sequentially at different radial positions outwardly from the sidewall along a forward circumferential direction with respect to the impeller to sequentially expand the flow channel outwardly in a radial direction at different circumferential positions along the forward circumferential direction with respect to the impeller; and a plurality of airflow entry tunnels, formed by the air deflectors between the base plate and the top plate;

wherein the air outlet and an opposite point are respectively at two opposite sides of the impeller, a forward included angle is a central angle having a vertex at a rotation center of the impeller, the included angle defined by an arc starting from the opposite point and extending along the forward circumferential direction, with respect to the impeller, to a forward end of the sidewall at one of the airflow entry tunnels, wherein the forward included angle is between 15 and 60 degrees, a pressurization area starts from the air outlet then through the opposite point and finally reaches a forward end of the sidewall along the sidewall and the forward circumferential direction, a combinational air input area is from the forward end of the sidewall to the air outlet along the air deflectors, the air deflectors are discrete sidewalls of the fan frame, and the base plate and the top plate do not protrude from the air deflectors.

* * * * *